US005221014A

United States Patent [19]

Welch et al.

[11] Patent Number: 5,221,014

[45] Date of Patent: Jun. 22, 1993

[54] MODULAR WIRE SHELVING SYSTEM AND METHODS FOR MAKING SHELVES AND VERTICAL SUPPORTS INCORPORATED THEREIN

[75] Inventors: Robert J. Welch, Dallas; Michael J. Sudimak, Shavertown; Joseph P. Jones, Wilkes-Barre, all of Pa.

[73] Assignee: InterMetro Industries Corporation, Wilkes-Barre, Pa.

[21] Appl. No.: 958,459

[22] Filed: Oct. 7, 1992

Related U.S. Application Data

[63] Continuation of Ser. No. 669,026, Mar. 13, 1991, abandoned.

[51] Int. Cl.[5] ..... A47F 5/00

[52] U.S. Cl. ..... 211/187; 211/181

[58] Field of Search ..... 211/187, 186, 181; 108/109, 110, 111

[56] References Cited

U.S. PATENT DOCUMENTS

| | | | |
|---|---|---|---|
| 3,138,123 | 6/1964 | Maslow | 108/159 |
| 3,145,846 | 8/1964 | Samuels et al. | 211/187 X |
| 3,146,735 | 9/1964 | Kesilman et al. | 108/111 |
| 3,183,862 | 5/1965 | Melvin | 108/144 |
| 3,208,408 | 9/1965 | Maslow | 108/159 X |
| 3,743,105 | 7/1973 | David | 211/153 |
| 4,391,378 | 7/1983 | Secon | 211/187 |
| 4,548,327 | 10/1985 | Kilkelly | 211/187 |

FOREIGN PATENT DOCUMENTS

| | | | |
|---|---|---|---|
| 663326 | 5/1963 | Canada | 211/187 |
| 2590144 | 11/1985 | France . | |
| 5721138 | 1/1958 | Italy | 211/187 |
| 1072036 | 6/1967 | United Kingdom | 211/187 |

*Primary Examiner*—David M. Purol

*Attorney, Agent, or Firm*—Fitzpatrick, Cella, Harper & Scinto

[57] ABSTRACT

A shelving system includes a shelf mat and a support structure for supporting the shelf mat. The shelf mat includes an object carrying portion for supporting objects and a projection connected to and projecting from the object support portion. The support structure includes a pair of vertical corner posts each having two vertical rods spaced by a distance sufficient to permit the insertion of the projection therebetween but to prevent substantial horizontal movement of the projection when the projection is so inserted. The support structure also includes a horizontal support, connected between the two vertical corner posts, and adapted to support at least a portion of said shelf when inserted between the two vertical rods. Methods of manufacturing the shelf mat and support structure using continuous mat-forming steps are also described.

28 Claims, 5 Drawing Sheets

MODULAR WIRE SHELVING SYSTEM AND METHODS FOR MAKING SHELVES AND VERTICAL SUPPORTS INCORPORATED THEREIN

This application is a continuation of application Ser. No. 07/669,026 filed Mar. 13, 1991, now abandoned.

BACKGROUND OF THE INVENTION

1. Field of the Invention

The present invention relates to an improved modular shelving system primarily for home use. More particularly, the present invention relates to an inexpensive shelving system for home use having modular components that can be easily assembled and disassembled without any tools, for shipment, storage, cleaning, and for changing the height of the shelves in of the shelving system.

While the shelving system of the present invention is especially well suited for home use, it can, of course, be used with equal advantage in many other environments.

2. Description of the Prior Art

Modular shelving systems, are well known. For example, U.S. Pat. Nos. 3,138,123 and 3,208,408 disclose knockdown shelving units that have achieved great commercial success under applicants' assignees' trademark ERECTA SHELF and that do not require tools for their assembly. These systems comprise a plurality of shelf components supported by two vertical supports. Each vertical support comprises two pairs of vertical rods interconnected by spaced horizontal stiffeners that form transverse supports for the shelf components. The central part of each stiffener includes a U-shaped portion that can elastically expand when appropriately stressed. The space separating the two pairs of vertical rods is smaller than the overall width of the shelf components. Thus, the shelf components must be tilted and forced down between the two pairs of vertical rods. The U-shaped portion of the stiffener permits this wedging action by expanding when each shelf component is forced between the two pairs of vertical rods. This wedging action is also facilitated by the use vertically spaced ribs of front and rear frames of each shelf component. The exterior edges of the ends of these ribs are formed with notched ends that engage the vertical rods when the shelf component is wedged between the two pairs of vertical rods. The notches in the ends of the ribs are made sufficiently large to permit the insertion of the shelf components between the pairs of vertical rods.

While this structure can be readily assembled at home and provides a stable, strong shelf system, it is believed that it may be improved further. First, the use of a variety of differently shaped elements, such as notched ribs and stiffeners having a U-shaped central section, increases the manufacturing costs of the system. Second, in order to assemble the system, the user must force the shelf components down between the closely spaced vertical rods against the force of U-shaped portions of the stiffeners. Similarly, when the user wishes to change the height of the shelves, the user must force the shelf components up against the force of the U-shaped portion of the stiffeners. This can require substantial effort, which may be difficult or inconvenient for some users.

Thus, there is a need for a shelving system that can be readily assembled at home without tools, which is also inexpensive and can be assembled with minimal effort.

SUMMARY OF THE INVENTION

It is an object of the present invention to improve upon the modular shelving systems known in the prior art.

It is another object of the present invention to provide a shelving system that can be readily assembled at home with minimal effort without tools and that is inexpensive.

It is still another object of the present invention to provide a shelving system in which the height of the shelf components can be quickly changed with minimal effort.

According to one aspect, in a preferred embodiment the shelving system of the present invention comprises a shelf and means for supporting the shelf. The shelf comprises an object carrying portion or mat for supporting objects, and a number of projections connected to and projecting from the mat. The means for supporting the shelf comprises a pair of vertical supports each having two pairs of vertical members spaced apart by a distance sufficient to permit the insertion of one projection from the shelf therebetween but to prevent substantial horizontal movement of the projection. The supporting means also comprises a horizontal support, connected between the two pairs of vertical members, which is adapted to carry a portion of the shelf in that vertical direction.

The shelf includes a frame surrounding and attached to the mat. Each projection protrudes from that frame. The frame comprises two lateral frame members and front and rear frame members attached to the two lateral frame members. The projections may be formed integrally with the front and rear frame members or the lateral frame members.

The shelving system also includes a plurality of transverse rods connecting the front and rear frame members at different points along the length thereof. In addition, the mat comprises a plurality of substantially parallel mat ribs attached to the frame members and the transverse rods. Thus, each transverse rod extends at substantially a right angle to the parallel mat ribs.

Instead of or in addition to the use of transverse rods to connect the two vertically spaced ribs comprising the front and rear frame members, a generally sinuously formed wire can be provided to connect those frame members at spaced points along the length thereof. Such a wire may also be connected between the lateral frame members.

In one preferred embodiment, the end portions of each of the spaced ribs defining the front and rear frame members form the projections by being bent substantially horizontally at approximately right angles with respect to a remaining portion of each of such spaced ribs. In a second embodiment, the lateral frame members each comprise two vertically spaced ribs. In this embodiment, the end portion of each of those spaced ribs form the projections by extending in the same direction as a remaining portion thereof.

In these preferred embodiments, the elements of the frame members, transverse rods and shelf mat are metal wire rods. These wire rods are interconnected by welding.

The shelving system may further comprise a snap-on cover adapted to snap over the projections from the shelf frame and the portion of the pair of vertical support members horizontally adjacent each such projection when inserted between the spaced vertical support members.

In still another embodiment of the present invention, each projection from the shelf frame comprises a detachable snap-on element adapted to snap onto a portion of the frame and onto each of the two vertical support members.

According to another aspect, the present invention relates specifically to a shelf for a shelving system configured to be supported by at least one pair of spaced vertical supports connected by a horizontal support. The shelf comprises a frame that includes a plurality of ribs. One of the ribs comprises two projections protruding in the same direction beyond the outer periphery of the frame. Each projection is sufficiently narrow to permit insertion thereof between the pair of spaced vertical supports but is sufficiently wide to permit no substantial horizontal movement when inserted between the pair of spaced vertical supports. The shelf also comprises a plurality of ribs attached to and extending within the frame to define an object carrying surface or mat within the frame thus for supporting objects.

The shelf mat still further comprises a plurality of transverse ribs extending transversely to and connected to the bottom of the plurality of ribs defining the object carrying surface. Another of the ribs comprises two projections in the same direction beyond the outer periphery of the frame. The ribs comprising the two projections are vertically spaced and are connected at a plurality of points along the length thereof by the plurality of transverse rods. The portion of each transverse rod which connects the ribs comprising the two projections extends at substantially a right angle to the portion of each transverse rod which is attached to the bottom of each of the plurality of ribs defining the object support surface.

The present invention also contemplates a method of making both the vertical support structures and the shelves by a continuous welding and subsequent wire bending procedure described in detail hereinafter.

A more complete appreciation along with an understanding of other aspects, objects, features, and advantages of the present invention will become apparent from the following detailed description, when considered in conjunction with the accompanying drawing.

DETAILED DESCRIPTION OF PREFERRED EMBODIMENTS

For purposes of explanation, it is to be understood that in this specification and the concluding claims, the location of elements of the shelving system of the present invention will be defined with reference to the fully assembled system. Accordingly, the term "horizontal" refers to directions parallel to a surface on which the fully assembled shelving system stands. Similarly, the term "vertical" refers to directions normal to that surface.

A. General Description

Figure 1:
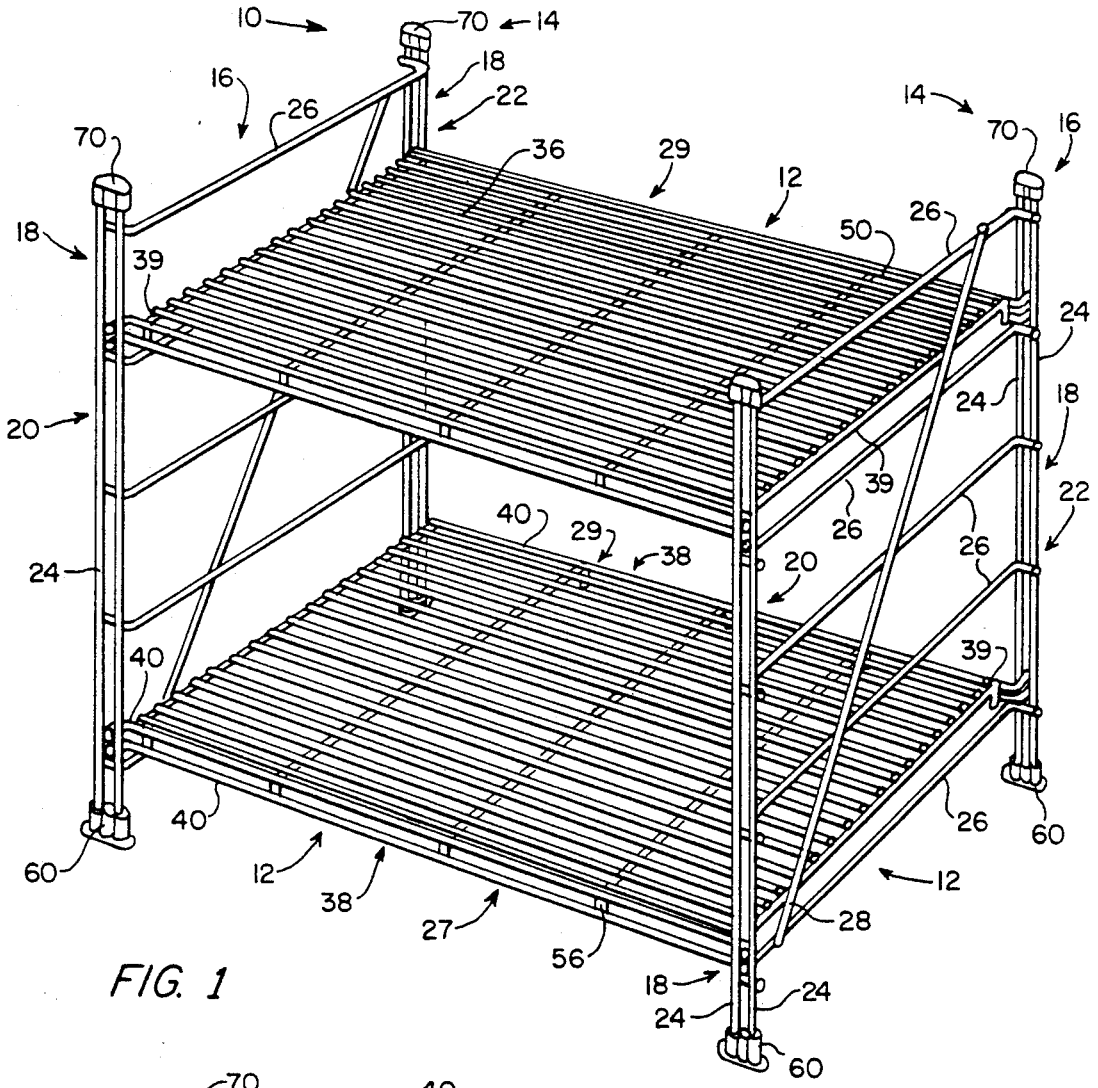
FIG. 1 is a perspective view of a shelving system in accordance with a first embodiment of the present invention.
Figure 2:
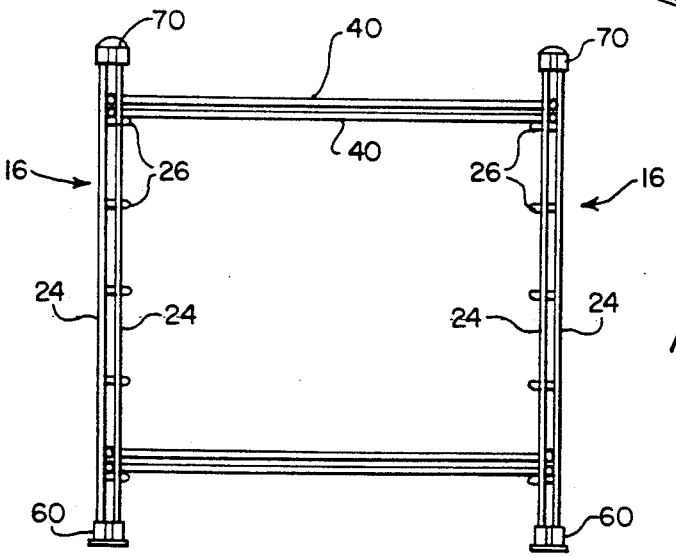
FIG. 2 is a front elevational view of the shelving system shown in FIG. 1.
Figure 3:
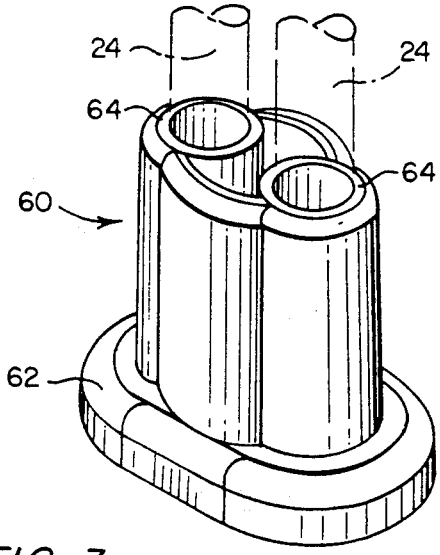
FIG. 3 is a perspective view of a foot for supporting the ends of the vertical rods of the vertical support structures of the present invention.
Figure 4:
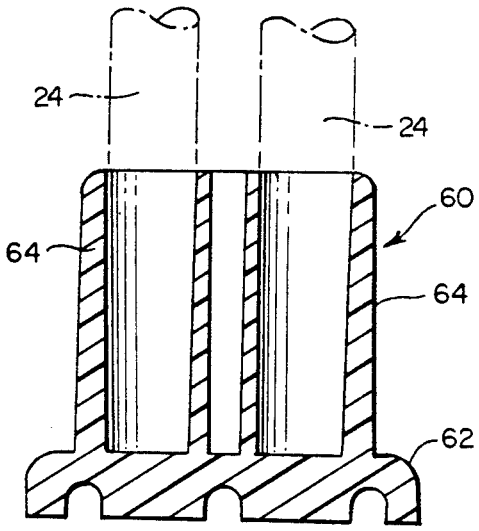
FIG. 4 is a vertical cross-sectional view of the foot shown in FIG. 3.

As shown in FIG. 1, the shelving system 10 of the present invention generally comprises a plurality of horizontal wire shelves 12 and a vertical wire support arrangement 14 for supporting the shelves 12. In all preferred embodiments, each of the wire shelves 12 and the wire support arrangement 14 are composed of a plurality of metal wires that are welded together. As described in greater detail below, to form individual shelves 12, a large wire mat, larger than the individual shelves 12, is continuously constructed by welding individual wire rods together. The large mat is then cut generally to form the individual shelves 12. The final desired configuration of each single wire shelf 12 is formed by bending individual components to the desired shape after the large mat is cut Consequently, the shelving system 10 is capable of supporting heavy loads and can be manufactured quickly and inexpensively.

In addition, the shelving system 10 is a modular one that can be shipped and stored in component pieces which can be easily assembled and disassembled. More particularly, the shelving system 10 includes two types of modular components, namely at least one shelf 12 and two lateral support structures 16 that together form the support arrangement 14 and support the respective opposing lateral sides of each shelf 12. Each lateral support structure 16 comprises two spaced vertical corner posts 18 rigidly connected by a plurality of horizontal rods 26, as will be discussed in more detail below.

Figure 5:
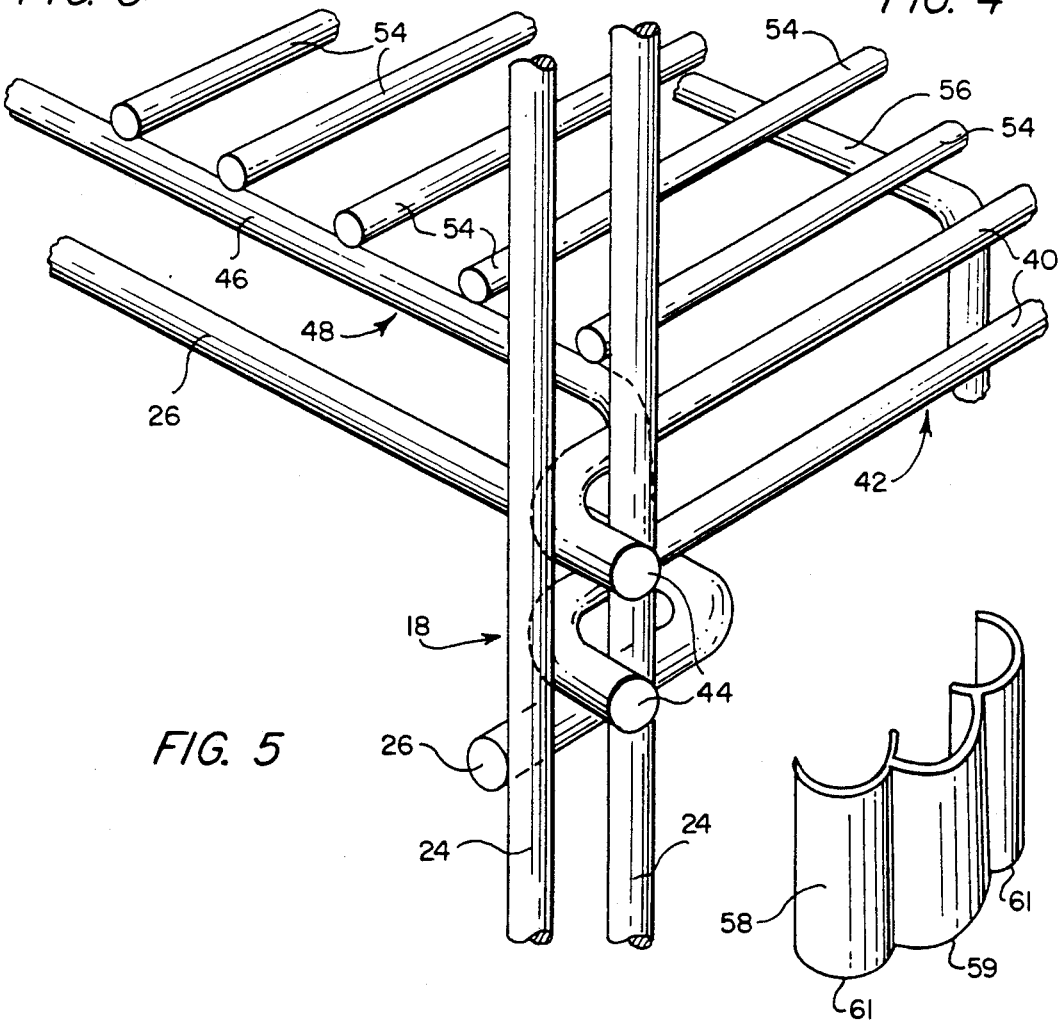
FIG. 5 is an enlarged perspective view of the corner of the shelf mat shown in FIG. 1 engaging a pair of vertical support rods, and a cover adapted to snap onto two projections of the shelf mat and the portion of the vertical, support rods adjacent the projections.
Figure 6:
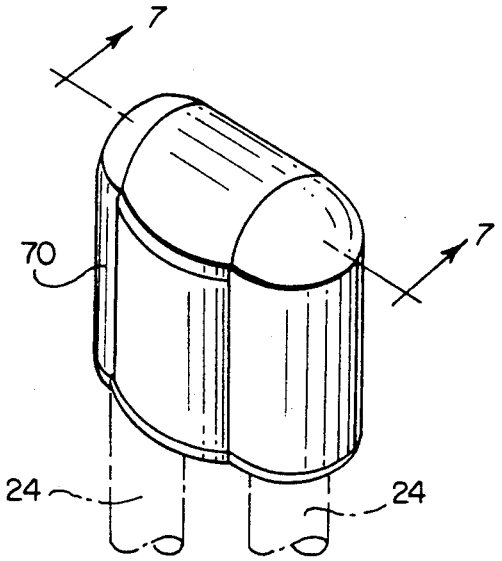
FIG. 6 is a perspective view of a top cap for the vertical support rods of the present invention.
Figure 7:
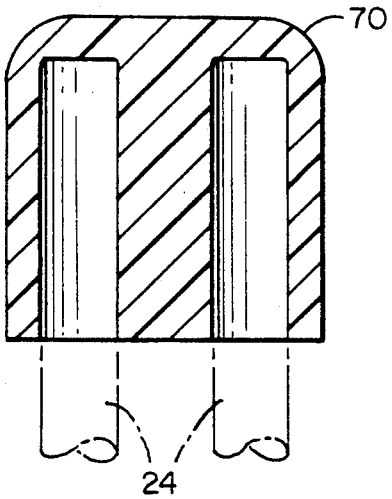
FIG. 7 is a vertical cross-sectional view of the cap shown in FIG; 6.
Figure 13:
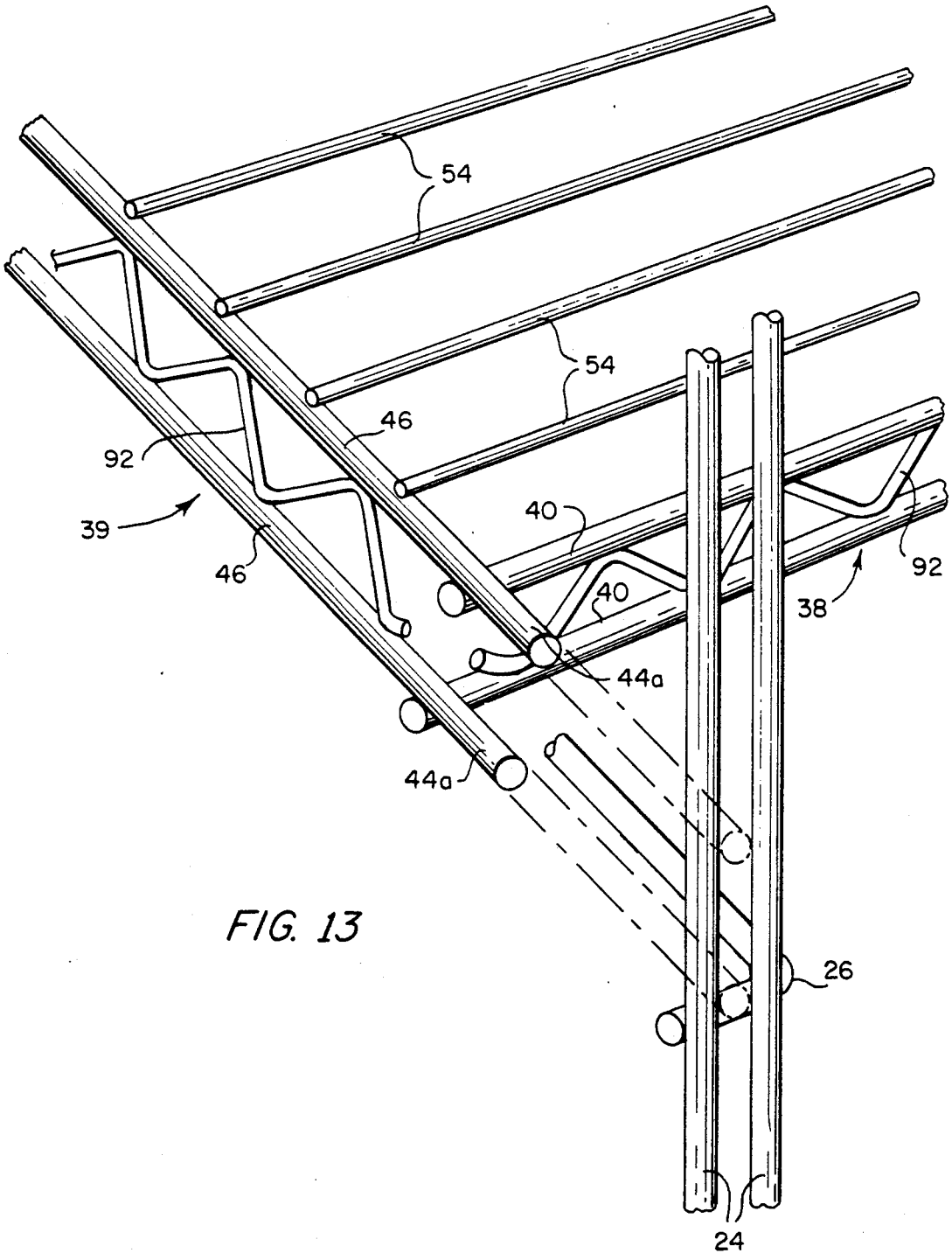
FIG. 13 is a perspective view of the corner structure of a third embodiment of the present invention, showing the manner in which the corner of the shelf mat engages the vertical supports.

Moreover, the corners of the shelving system 10, at which the shelves 12 may be carried by the support structures 16, are simple in design and permit quick and easy assembly of the system. Briefly, as shown in FIGS. 1, 5, and 13, each corner post of each vertical structure 16 comprises two spaced vertical rods 24 connected by the horizontal rods 26. Each horizontal rod 26 supports the end of a rib 40 projecting from a frame of the shelf mat 12.

To assemble the shelving system, the user need only (a) place the two vertical support structures 16 at a distance from each other equal to the length of a shelf 12;

(b) tilt the front 27 of each shelf 12 with to the rear 29 thereof (or vice versa), (c) insert the ends of the ribs 40 at the front 27 of the shelf 12 between the spaced vertical rods 24 of the front most corner posts 20 so that the ribs 40 are supported by horizontal rods 26, and (d) slide the ends of the ribs 40 at the rear 29 of the shelf 12 down until they are inserted between the spaced vertical rods 24 of the rear most posts 22 such that the ribs 40 also supported by the horizontal rods 26.

The height of any one of the shelves 12 can be changed by reversing this process, without removing any of the other shelves 12, and repositioning the one shelf. The simplicity of this design reduces manufacturing costs. In addition, the simplicity of the method for assembling the shelving system 10 and changing the height of the individual shelves 12 renders the system convenient and easy to use.

B. The Vertical Support Arrangement

The vertical support arrangement 14 will now be described in more detail. As shown in FIG. 1, the support arrangement 14 comprises the two vertical support structures 16. Each support structure 16 comprises two spaced vertical corner posts 18, namely a front vertical corner post 20 and a rear vertical corner post 22. Each vertical corner post 18 comprises two spaced vertical rods 24. Each front corner post 20 is connected to one rear corner post 22 by a plurality of horizontal rods 26. The horizontal rods 26 are bent at each end at substantially a right angle also to interconnect the vertical rods 24 of the respective front and rear corner posts 20 and 22. The horizontal rods 26 perform several functions. First, they connect and rigidly hold front and rear corner posts 20, 22 together to form the lateral support structure 16. Second, the horizontal rods 26 form support surfaces for the shelves 12 as will be described in greater detail below.

Figure 10:
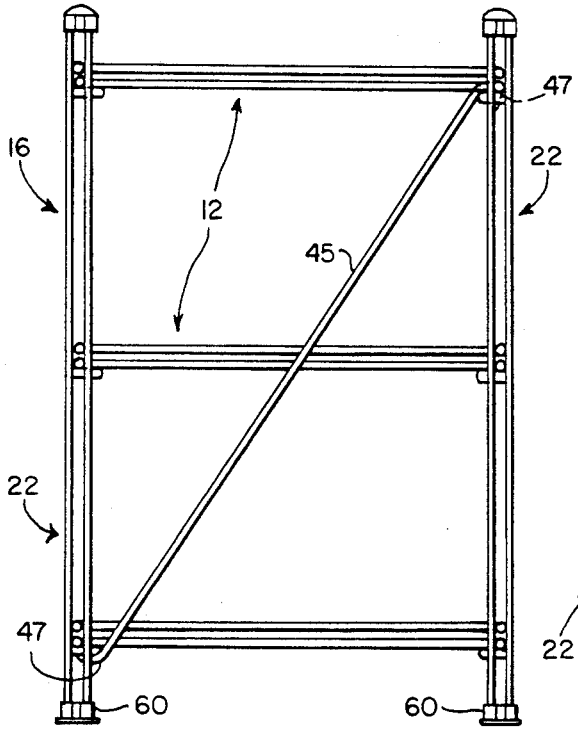
FIG. 10 is a rear elevational view of a short form of the first embodiment of the shelving system of the present invention having one side-to-side cross brace.
Figure 11:
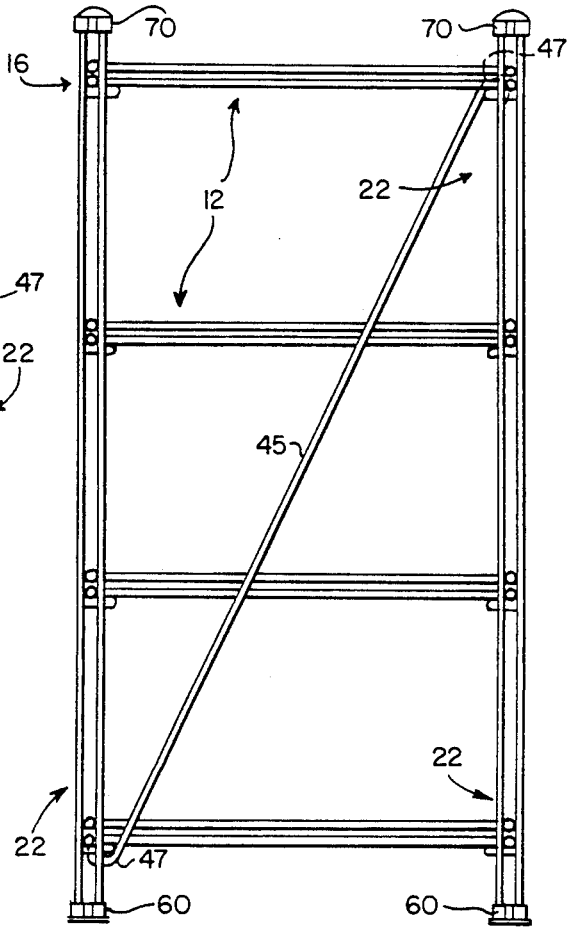
FIG. 11 is a rear elevational view of a tall form of the first embodiment of the shelving system of the present invention also having one side-to-side cross brace.

FIG. 1 shows a vertical support structure having five horizontal rods 26. FIG. 10 illustrates another embodiment showing such a structure with three horizontal rods 26, and FIG. 11 illustrates still another embodiment showing the structure with four horizontal rods 26. It should be understood that these are merely exemplary embodiments, and that the invention is not limited to the number of horizontal rods 26 or shelves 12 carried thereon shown in the drawings.

To increase the stability of the lateral support structures 16, cross braces 28 can be attached thereto. The embodiment illustrated in FIG. 1 shows the top end of the cross brace 28 welded to the rear end of the uppermost horizontal rod 26 and the bottom end of the cross brace 28 welded to the front end of the lowermost horizontal rod 26. Although only one cross brace 28 for each lateral support structure 16 is shown in FIG. 1, it should be understood that two or more cross braces 28 can be used, for example, in an X-shaped configuration. Moreover, it should also be understood that for small lateral support structures 16 which may be 33 inches tall, for example, the cross brace 28 may be omitted, whereas for taller lateral support structures 16 which are, for example, 48 inches or 54 inches tall, one or two cross braces 28 are preferably incorporated.

The lateral support structures 16 are also stabilized by plastic feet 60, as is shown in FIGS. 1, 2, 3 and 4. Each foot 60 supports the two vertical rods 24 of a corner post 18, comprises a base 62 and two housings 64 which extend vertically from the base 62. Each housing 64 is dimensioned to tightly receive the bottom end of one of the vertical rods 24 therein.

The support arrangement 14 further comprises a plurality of plastic caps 70 which are placed on the top ends of the rods 24 forming each corner post 18, as shown in FIGS. 1, 2, 6 and 7. Each cap 70 has two housings, each dimensioned tightly to receive the top end of one of the vertical rods 24 therein.

Figure 8:
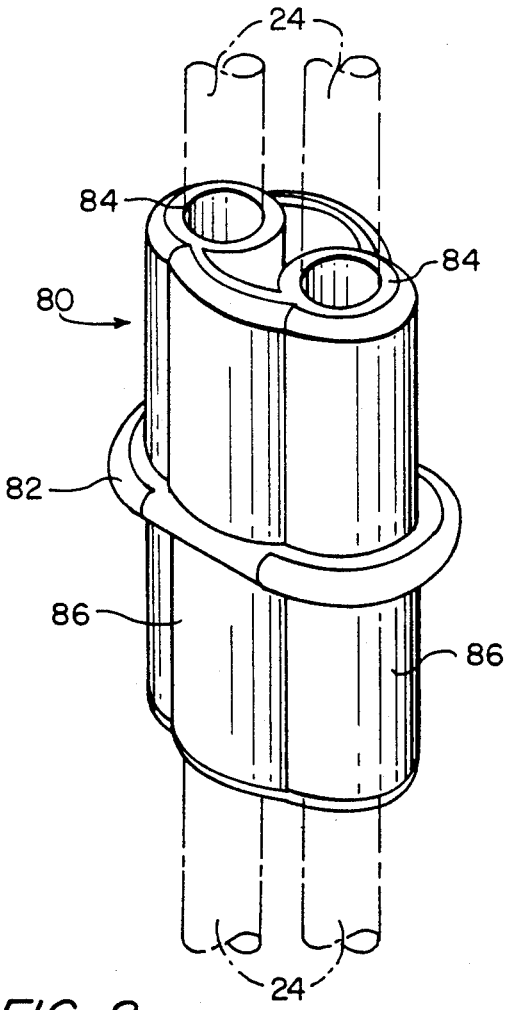
FIG. 8 is a perspective view of a connector for connecting two pairs of vertical support rods of the present invention.
Figure 9:
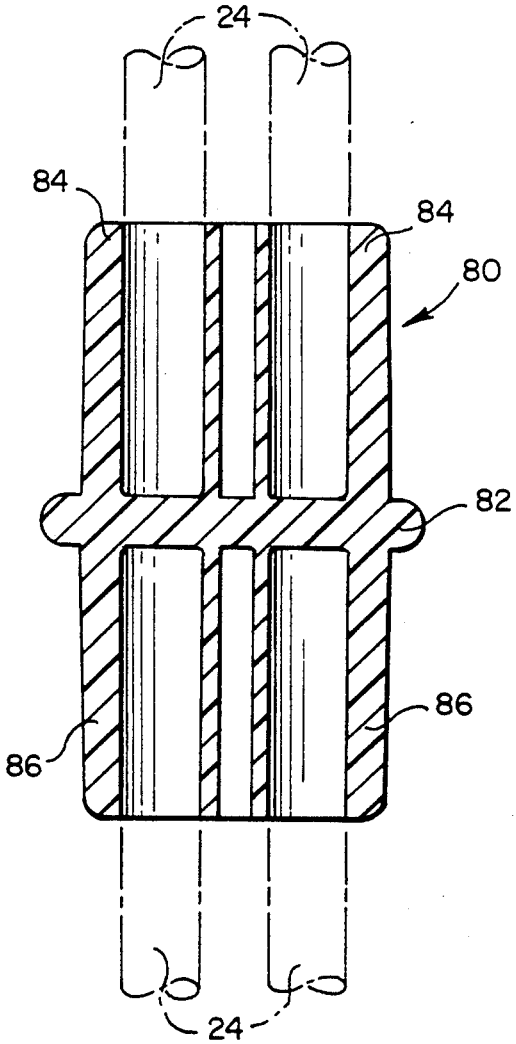
FIG. 9 is a vertical cross-sectional view of the connector shown in FIG. 8.

Separate shelving systems 10 can be stacked one on top of another. This arrangement provides maximum flexibility in satisfying the needs of users for systems of different heights. Such stacking is accomplished with four plastic connectors 80, one of which is shown in FIGS. 8 and 9. The connector 80 comprises a base 82, two housings 84 extending upwardly from the base 82, and two housings 86 extending downwardly from the base 82. Pairs of the upwardly and downwardly extending housings are axially aligned as clearly shown. The upwardly extending housings 84 are dimensioned tightly to receive the bottom ends of the vertical rods 24 of a corner post 18 therein. The downwardly extending housings 86 are dimensioned tightly to receive the top ends of the vertical rods 24 of a different corner post 18 therein. The connector 80 thus axially vertically aligns the rods of respective upper and lower corner posts of the stacked shelving systems so that the posts continue to provide primary vertical load bearing.

It will be understood from the description provided above that each support structure 16 can be made in a continuous mat welding process. For example, the vertical rods 24, horizontal rods 26 and cross braces 28 can be made as a continuous welded wire mat. Thereafter, sections of the continuous mat can be cut to the desired vertical height of a support structure 18 and the horizontal rods 26 can be bent near their respective ends adjacent the welded attachment to the vertical rods, at a 90 degree angle. The bending operation produces the U-shaped configuration in plan view of the horizontal rods as can be seen in FIG. 1.

The continuous welding process described above avoids the need for making an undue number of custom welds to secure separate wire components to the structure after it is made to proper size and thereby improves the efficiency of manufacturing and reduces cost.

C. The Horizontal Shelves

Figure 12:
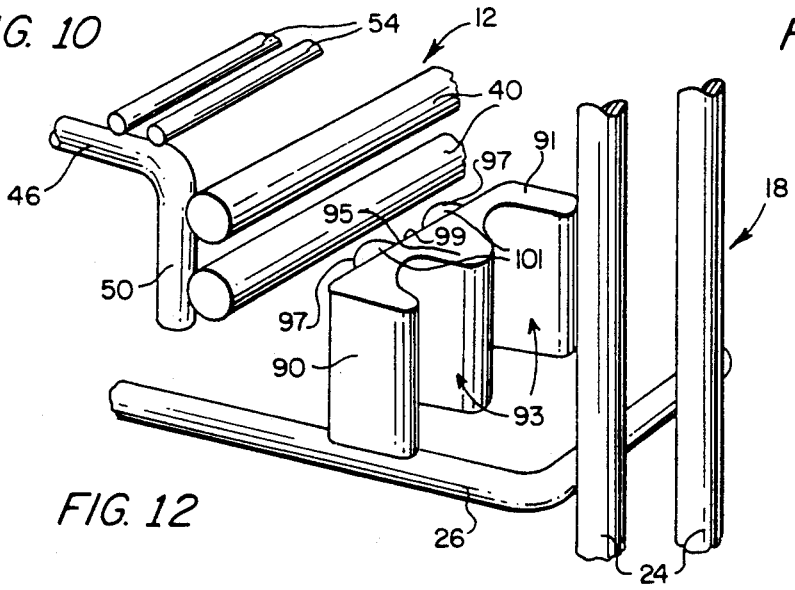
FIG. 12 is a perspective schematic view of the corner structure of a second embodiment of the present invention, showing a snap-on coupling member which snaps onto a rod of the shelf mat and which snaps onto each of the rods of the vertical supports to couple the shelf mat to the vertical supports.

The structure of the horizontal shelves 12 will now be described in detail. FIGS. 1, 2, 5, 10, and 11 show a first embodiment of each shelf 12, FIG. 12 shows a second embodiment of the shelf 12, and FIG. 13 shows a third embodiment. FIGS. 5, 12, and 13 show the manner in which the corners of the shelf 12 engage the vertical support posts 18.

The shelf 12 in each embodiment is rectangular in shape, having four identical corner structures. However, it should be understood that it is within the scope of the present invention for the shelf 12 to have other shapes, such as square, triangular, or similar shapes.

In the first embodiment, the shelf 12 comprises a frame which surrounds and supports an object carrying portion or shelf mat 36 adapted to support objects placed thereon. The frame comprises identical front and rear frame members 38 and identical lateral frame members 39.

The front and rear frame members 38 each comprise two vertically spaced wire ribs 40. Each rib 40 comprises a major portion 42 that defines the front or rear edges of the mat 36. The two ends of each rib 40 are formed with a short projection 44. Each projection 44 on a given front or rear frame 38 extends horizontally in the same direction at substantially a right angle with respect to the major portion 42. In addition, the projections 44 extend beyond the front or rear edges of the object carrying portion 36.

The distance between the spaced vertical rods 24 of each corner post and the dimensions of the projections 44 are such as to permit the insertion of the projections 44 between the vertical rods 24 while preventing substantial horizontal movement of the projections 44 when so inserted, all as shown in detail in FIGS. 1 and 5.

Moreover, the use of two projections 44, as shown in detail in FIG. 5, that tightly fit between the vertical rods 24 comprising each corner post provides the assembled system with side-to-side stability. Alternatively, one projection having substantial height relative to the space between the rods 24 may be used in place of the vertically spaced projections 44 to provide similar side-to-side stability for the assembled system. In each case, as is clearly shown, for example, in FIGS. 1, 2, 5, 10, 11, and 13, the projections or projection are configured to have sufficient height to resist rotation about the interconnection between them and the vertical rods.

It will be appreciated that, when the projections 44 are inserted between the vertical rods 24 comprising a corner post 18, at least some portion of the shelf 12 will be supported on the horizontal rod 26. As shown in detail in FIG. 5, the lower most projection 44 and the end of the major portion 42 of the lower most frame-forming rib 40 from which that projection is bent are both supported on the horizontal rod 26 thus vertically to support the shelf 12.

The lateral frame members 39 each comprise at least one transverse rib 46 that extends transversely to the front and rear frame members 38. The transverse rods 46 comprise a horizontal portion 48 to which additional mat-defining ribs 54 of the object support portion 36 are welded. In addition, the transverse rods 46 each comprise at each end a connecting portion 50, which is bent downwardly at substantially a right angle with respect to the horizontal portion 48. Connecting portions 50 are welded near the lateral extremes of the major portions 42 of ribs 40 of the front and rear frame members 38.

Furthermore, a plurality of additional transverse rods 56 are welded to the bottom of the mat-defining ribs 54 of the mat 36. The ends of the transverse rods 56 are also bent downwardly substantially at a right angle with respect to the major portion of each welded to the bottom of the ribs 54. The ends of the transverse rods 56 are thus welded to the portions 42 of the front and rear frame member ribs 40 at spaced points along the lengths thereof.

The wires comprising the various frame members can be of a higher gauge than or the same gauge as the wires comprising the object support portion 36.

It will again be appreciated that the shelf mat structure may be made by a continuous welding process in which, for example, the mat-defining ribs 54 and front and rear frame ribs 40 are laid in parallel, and the transverse ribs 56 and 46 are welded perpendicularly thereto. The transverse ribs 56 and 46 are then cut to desired length and bent at opposing ends to cause the two ribs 40 at each end thereof to depend from the major portion of the mat and define the front and rear frame members. Thereafter, the mat-forming wires are cut to shorter length to define the shelf mat, while the front and rear frame member ribs 40 are left longer and bent at 90 degrees to define the projections 44. Of course, other orders of performing these manufacturing steps may be contemplated by those skilled in the art.

Turning now to FIG. 5, a plastic snap-on cover 58 is illustrated that is adapted to snap over the two projections 44 and the portion of vertical rods 24 that are horizontally adjacent the projections 44 when inserted between the vertical rods 24. More specifically, the cover 58 comprises a central section 59 dimensioned to permit snapping over the ends of the projections 44, and two outer sections 61 dimensioned to permit snapping onto the portions of the vertical rods 24 adjacent the projections 44. Accordingly, this cover provides an aesthetically pleasing appearance.

FIGS. 10 and 11 illustrate an accessory for the shelving system of the present invention in the form of a rear side-to-side cross brace 45 that diagonally interconnects the opposing lateral supports. This cross brace 45 may be provided with a sheppard's hook 47 at each end, each of which embraces one horizontal support 26 in the region of the rear corner posts 22 at the opposing top and bottom of the respective vertical support structures 16. Of course, two such cross braces 45 may be provided at the rear of a shelving system assembly and would be arranged in an X-shaped configuration.

FIG. 12 illustrates a second embodiment of the present invention, in which elements having the same structure or function as elements of the first embodiment are labelled with the same reference numerals. However, unlike the embodiment illustrated in detail in FIG. 5, in which each corner of the shelf 12 directly engages the vertical corner post 18, this second embodiment uses an intermediate snap-on coupling member 90 for coupling the corner of the shelf 12 to the vertical corner post 18. The coupling member 90 comprises a base 91 formed with two vertically extending channels 93 that share a common wall 95 and that are spaced to snap onto and embrace both of the vertical rods 24 comprising a corner post 18. The common wall 95 is adapted to be inserted between the vertical rods 24. Facing the shelf 12 are a pair of parallel flanges 97 that together define a channel 99 adapted to receive the depending end or connecting portion 50 of one transverse rod 46 between the ribs 40 of a front or back frame member. The upper most of the ribs 40 is then carried on the tops 101 of the flanges 97 while the bottom of the housing 90 is supported on a horizontal rod 26 of a vertical support structure 16, thereby to vertically support the shelf mat.

FIG. 13 illustrates a third embodiment of the present invention. Again in this figure, elements having the same structure or function as elements of the first embodiment are labelled with the same reference numerals. This embodiment differs from the first embodiment in that the projections that are inserted between the vertical rods 24 of each corner post are not projections bent from ribs 40 forming the front and rear frame members 38. Rather, extensions of transverse rods 46 defining the lateral frame members 39 constitute the projections 44*a* to be inserted between the vertical rods 24 defining each corner post.

More specifically, the lateral frame members 39 and the front and rear frame members 38 each comprise two vertically spaced ribs 46 and 40 respectively that are straight. The ends of the spaced ribs 40 of the front and rear frame members 38 are welded at a welding point to the respective spaced ribs 46 of the lateral frame members 39. The welding point is spaced from the ends of those ribs 46. Consequently, the extremes of the ribs 46 of the lateral frame members 39 define the projections 44*a* which are inserted between adjacent vertical rods 24. As in the previous embodiments, the distance between the spaced vertical rods 24 and the dimensions of the projections 44*a* are such as to permit the insertion of the projections 44*a* between the vertical rods 24 while preventing substantial horizontal movement of the projections 44*a* when so inserted. In this embodiment as shown the end of the lower most rib 40 is supported on the horizontal rod 26.

In addition, this third embodiment is shown with an enhanced stiffening structure in the form of a generally sinuous or "snake-like" wire 92 welded between the ribs 40 and 46 of the respective front, rear and lateral frame members. Of course, this stiffening wire may also be used in the other embodiments.

Various modifications to the embodiments described above may be made by those skilled in the art. For example, one shelf configuration now contemplated incorporates the front and rear frame members each Comprised of upper and lower spaced wire ribs 40, bent at their opposing ends to form projections 44, all as shown in FIGS. 1 and 5. A snake-like stiffening member 92, such as shown in FIG. 13, is welded between these spaced wire ribs. A single lateral frame wire 46 is provided at each side of the shelf and is welded to the undersides of the upper ribs 40 and of the mat-forming wires 54. The depending connecting portions 50 of these frame wires 46 and the depending portions of each mat-forming wire 56, shown in FIG. 1, are omitted. That is each of the frame wires and mat-forming wires terminates at and is welded to the bottom of the upper rib 40.

Thus, it will be appreciated that the present invention provides many improvements over known shelving systems, especially those for home use, in the areas of ease of assembly and low cost manufacture.

Although specific embodiments of the present invention have been described above in detail, it will be understood that this description is merely for purposes of explanation. Modifications of the preferred embodiments in addition to those described above may be made by those skilled in the art without departing from the scope of the present invention which is set forth in the following claims.

What is claimed is:

1. A method of manufacturing a wire shelf for a modular shelving system, said method comprising the steps of:

laying a plurality of matdefining wires in parallel relation, substantially in one plane;

placing a plurality of transverse rod-defining wires in mutually spaced parallel relation adjacent said mat-defining wires in perpendicular relation thereto;

welding said plurality of mat-defining wires and said plurality of transverse rod-defining wires together at the points of adjacency;

bending said transverse rod-defining wires in the regions of their opposing ends so that at least one mat-defining wire at each said opposing end is not positioned in the plane formed by the remainder of said mat-defining wires; said one mat-defining wire at each said opposing end of said transverse rod-defining wires, in conjunction with the mat-defining wire adjacent thereto, forming a frame member for said shelf; and bending said one mat-defining wire at its opposing ends to form a projection from said shelf at each of said ends thereof.

2. The method according to claim 1, further comprising the step of bending each said projection at an angle from the remaining portion of each said one mat-defining wire.

3. The method according to claim 1, wherein one of said plurality of mat-defining wires and said plurality of transverse rod-defining wires is essentially continuous, and further comprising the step of;

cutting said plurality of continuous wires to lengths substantially equal to one of the lateral and longitudinal dimension of said shelf, prior to said bending step.

4. The method according to claim 1, further comprising the step of bending a second mat-defining wire, adjacent said one mat-defining wire, at the said opposing ends of said transverse rod defining wires at its opposing ends, also to form a projection from said shelf at each of said ends thereof.

5. A method of manufacturing a vertical wire support for a modular shelving system, said method comprising the steps of:

laying a plurality of horizontal support-defining wires in parallel relation, substantially in one plane;

placing a first pair of vertical corner post-defining wires in mutually spaced parallel relation adjacent said horizontal support-defining wires in perpendicular relation thereto;

placing a second pair of vertical corner post-defining wires in mutually spaced parallel relation adjacent said horizontal support-defining wires in perpendicular relation thereto and spaced from said first pair, one of said plurality of horizontal support-defining wires and said pairs of vertical corner post-defining wires being essentially continuous;

welding said pairs of corner post-defining wires and said plurality of horizontal support-defining wires together at the points of adjacency;

cutting said continuous wires to lengths substantially equal to one of the lateral and vertical dimension of said vertical wire support; and bending said horizontal support-defining wires in the regions of their opposing ends so that each pair of corner post-defining wires lies in a plane not parallel to the plane defined by the remaining portions of said horizontal support-defining wires.

6. The method according to claim 5, wherein said planes in which said pairs of corner post-defining wires lie are substantially parallel and mutually perpendicular to the plane defined by said remaining portions of said horizontal support-defining wires.

7. The method according to claim 5, further comprising the step of welding a wire cross brace to said vertical wire support structure extending at a non-perpendicular angle to said horizontal support-defining wires.

8. A shelving system comprising:

A. a shelf including:

(1) an object carrying portion for carrying objects to be placed on said shelf;
(2) a frame surrounding and attached to said object carrying portion; and
(3) a projection connected to and projecting from said object carrying portion; and B. means for supporting said shelf, including:
(1) a pair of vertical supports comprising two vertical support members spaced by a distance sufficient to permit the insertion of said projection therebetween but to prevent substantial horizontal movement of said projection when said projection is so inserted; and
(2) a horizontal support, connected between said two vertical supports, adapted to support at least a portion of said shelf when said projection is inserted between said two vertical support members;

said projection comprising a detachable snap-on element adapted to snap onto a portion of said frame and adapted to snap onto each of said two vertical supports, said snap-on element including a first surface engageable on said horizontal support and a second surface engageable on said frame thereby to vertically support said shelf on said support means.

9. A subassembly for a shelving system comprising:

A. a shelf including:
(1) an object carrying portion for supporting objects;
(2) a frame surrounding and attached to said object carrying portion; and
(3) a projection connected to and projecting from said object carrying portion; and B. two vertical supports spaced by a distance sufficient to permit the insertion of said projection therebetween but to prevent substantial horizontal movement of said projection when said projection is inserted therebetween; and C. a horizontal support, connected between said two vertical supports, adapted to support at least a portion of said shelf when said projection is inserted between said two vertical supports;

said projection comprising a detachable snap-on element adapted to snap onto a portion of said frame and adapted to snap onto each of said two vertical supports.

10. A shelving system comprising:

A. a shelf including:
(1) an object carrying portion for carrying objects to be placed on said shelf;
(2) a plurality of lateral rods connected to and supporting said object carrying portion, front and rear portions of each of said rods in the regions of the ends thereof depending at a substantially right angle to the remainder thereof;
(3) front and rear longitudinal frame members each comprising two vertically spaced frame ribs, said frame ribs of said front frame member being connected to said front portions of said lateral rods and said frame ribs of said rear frame member being connected to said rear portions of said lateral rods, the opposing ends of each of said frame ribs extending at a substantially right angle from the remainder thereof to define a pair of frontwardly extending vertically spaced projections from said each end of said front frame member and a pair of rearwardly extending vertically spaced projections from each end of said rear frame member; and B. means for supporting each end of said shelf, each said supporting means including:
(1) a pair of vertical supports spaced by a lateral distance substantially equal to the distance between said front and rear frame members, each said vertical support comprising two vertical support members spaced by a distance sufficient to permit tight insertion of one of said projections from said frame members therebetween but to prevent substantial horizontal movement of said one projection when said one projection is so inserted, the space between the projections in each said pair of frontwardly and rearwardly extending projections being sufficient relative to the space between said two support members comprising each said vertical support to provide stability of said shelf and said supporting means, when assembled together, in the longitudinal direction by providing resistance to rotation about the interconnection of said support members and said pairs of projections; and
(2) a horizontal support, connected to each of said vertical supports, adapted to support at least a portion of said shelf when one said pair of projections is inserted between said two vertical support members comprising each said support.

11. The shelving system recited in claim 10, wherein said object carrying portion comprises a plurality of substantially parallel longitudinally extending ribs, and wherein each lateral rod is attached to the bottom of each of said parallel ribs.

12. The shelving system recited in claim 11, wherein each said frame rib comprises a metal wire rod, wherein each said object carrying portion rib comprises a metal wire rod, wherein each of said lateral rods comprises a metal wire rod, and wherein said metal wire rods are interconnected by welding.

13. The shelving system recited in claim 10, further comprising a generally sinuously formed stiffening element connected said two vertically spaced frame ribs comprising each of said frame members at spaced points along the length thereof.

14. The shelving system recited in claim 10, wherein at least two of said horizontal supports are connected between two pairs of said vertical support members thereby to form a unitary lateral support structure for supporting one end of said shelf.

15. The shelving system recited in claim 14, wherein said pairs of vertical support members comprise two front pairs of vertical support members and two rear pairs of vertical support members, and wherein each unitary structure comprises one front pair of vertical support members and one rear pair of vertical support members.

16. The shelving system recited in claim 10, further comprising a snap-on cover adapted to snap over each said pair of projections and the portion of said pair of vertical support members horizontally adjacent each said pair of projections when said pair of projections is inserted between said vertical support members.

17. A shelving system comprising:

A. a shelf including:
(1) an object carrying portion for carrying objects to be placed on said shelf;
(2) first and second laterally extending frame members each comprising two vertically spaced frame ribs at least one of which is connected to said object carrying portion at opposing ends of said shelf and the opposing ends of which project beyond the longitudinal boundaries of said object carrying portion in the region of said connection thereby to define a pair of vertically spaced forwardly extending projections and a pair of vertically spaced rearwardly extending projections at each end of said shelf; and B. means for supporting each end of said shelf, each said supporting means including:

(1) a pair of vertical supports spaced by a lateral distance substantially equal to the distance between said front and rear longitudinal boundaries of said object carrying portion in the region of said connection to one said lateral frame member, each said vertical support comprising two vertical support members spaced by a distance sufficient to permit tight insertion of one of said projections from said frame members therebetween but to prevent substantial horizontal movement of said one projection when said one projection is so inserted, the space between the projections in each said pair of frontwardly and rearwardly extending projections being sufficient relative to the space between two support members comprising each said vertical support to provide stability of said shelf and said supporting means, when assembled together, in the longitudinal direction by providing resistance to rotation about the interconnection of said support members and said pairs of projections; and (2) a horizontal support, connected to each of said vertical supports, adapted to support at least a portion of said shelf when one said pair of projections is inserted between said two vertical support members comprising each said support.

18. The shelving system recited in claim 17, wherein said object carrying portion comprises a plurality of substantially parallel longitudinally extending ribs each connected to said first and said second frame members.

19. The shelving system recited in claim 18, wherein said each of frame ribs and said object carrying ribs comprises a metal wire rod, and wherein said metal wire rods are interconnected by welding.

20. The shelving system recited in claim 17, further comprising a generally sinuously formed stiffening element connecting said two vertically spaced frame ribs comprising each of said frame members at spaced points along the length thereof.

21. A shelf for a shelving system supported by at least one pair of spaced vertical supports, each including two vertical support members, connected by a horizontal support; said shelf comprising:

(A) an object carrying portion for carrying objects to be placed on said shelf;

(B) a plurality of lateral rods connected to and supporting said object carrying portion, front and rear portions of each of said rods in the regions of the ends thereof depending at a substantially right angle to the remainder thereof;

(C) front and rear longitudinal frame members each comprising two vertically spaced frame ribs, said frame ribs of said front frame member being connected to said front portions of said lateral rods and said frame ribs of said rear frame member being connected to said rear portion of said lateral rods, the opposing ends of each of said frame ribs extending at a substantially right angle from the remainder thereof to define a pair of frontwardly extending vertically spaced projections from said each end of front frame member and a pair of rearwardly extending vertically spaced projections form each end of said rear frame member, each of said frontwardly extending projections and of said rearwardly projections being adapted to be received between two vertical support members comprising one said vertical support.

22. The shelving system recited in claim 21, wherein said object carrying portion comprises a plurality of substantially parallel longitudinally extending ribs, and wherein each said lateral rod is attached to the bottom of each of said parallel ribs.

23. The shelving system recited in claim 21, further comprising a generally sinuously formed stiffening element connecting said two vertically spaced frame ribs comprising each of said frame members at spaced points along the length thereof.

24. The shelving system recited in claim 23, wherein each said frame rib comprises a metal wire rod, wherein each said object carrying rib comprises a metal wire rod, wherein each of said lateral rods comprises a metal wire rod, and wherein said metal wire rods are interconnected by welding.

25. The shelf for a shelving system supported by at least one pair of spaced vertical supports, each including two vertical support members, connected by a horizontal support; said shelf comprising:

(A) an object carrying portion for carrying objects to be placed on said shelf; and (B) first and second laterally extending frame members each comprising two vertically spaced frame ribs at least one of which is connected to said object carrying portion at opposing ends of said shelf and the opposing ends of which project beyond the longitudinal boundaries of said object carrying portion in the region of said connection thereby to define a pair of vertically spaced forwardly extending projections and a pair of vertically spaced rearwardly extending projections at each end of said shelf, each of said frontwardly extending projections and of said rearwardly extending projections being adapted to be received between two vertical support members comprising one said vertical support.

26. The shelving system recited in claim 25, wherein said object carrying portion comprises a plurality of substantially parallel longitudinally extending ribs each connected to at least one of said first and said second frame members.

27. The shelving system recited in claim 26, further comprising a generally sinuously formed stiffening element connecting said two vertically spaced frame ribs comprising each of said frame members at spaced points along the length thereof.

28. The shelving system recited in claim 27, wherein said each of frame ribs and said object carrying ribs comprises a metal wire rod, and wherein said metal wire rods are interconnected by welding.

* * * * *

UNITED STATES PATENT AND TRADEMARK OFFICE

CERTIFICATE OF CORRECTION

PATENT NO. : 5,221,014

DATED : June 22, 1993

INVENTOR(S) : ROBERT J. WELCH ET AL.

It is certified that error appears in the above-identified patent and that said Letters Patent is hereby corrected as shown below:

COLUMN 1

Line 18, "in" should be deleted.
Line 43, "use" should read --use of--.

COLUMN 4

Line 50, "cut" should read --cut.--.

COLUMN 5

Line 9, "with" should read --with respect--.
Line 10, "versa)," should read --versa);--.
Line 12, "front" should read --front- --.
Line 14, "26, and" should read --26; and--.
Line 17, "rear most" should read --rearmost--.
Line 18, "also" should read --are also--.

COLUMN 8

Line 29, "sheppard's" should read --shepherd's--.
Line 54, "upper" should read --upper- --.

UNITED STATES PATENT AND TRADEMARK OFFICE

CERTIFICATE OF CORRECTION

PATENT NO. : 5,221,014

DATED : June 22, 1993

INVENTOR(S) : ROBERT J. WELCH ET AL.

It is certified that error appears in the above-identified patent and that said Letters Patent is hereby corrected as shown below:

COLUMN 9

Line 31, "Comprised" should read --comprised--.
Line 42, "is" should read --is,--.
Line 61, "matdefining" should read --mat-defining--.

COLUMN 12

Line 42, "connected" should read --connecting--.

COLUMM 14

Line 2, "portion" should read --portions--.
Line 7, "front" should read --said front--.
Line 9, "form" should read --from--.
Line 11, "rearwardly" should read --rearwardly extending--.
Line 30, "The" should read --A--.
Line 62, "said each of" should read --each of said--.

Signed and Sealed this

Twenty-first Day of December, 1993

Attest:

Bruce Lehman

BRUCE LEHMAN

Attesting Officer

Commissioner of Patents and Trademarks